US005297525A

United States Patent [19]

Krebs et al.

[11] Patent Number: 5,297,525

[45] Date of Patent: Mar. 29, 1994

[54] METHOD FOR DETERMINING THE QUANTITY OF FUEL INJECTED

[75] Inventors: Stefan Krebs; Björn Miener, both of Regensburg, Fed. Rep. of Germany

[73] Assignee: Siemens Aktiengesellschaft, Munich, Fed. Rep. of Germany

[21] Appl. No.: 30,192

[22] PCT Filed: Sep. 3, 1991

[86] PCT No.: PCT/EP91/01664

§ 371 Date: Mar. 16, 1993

§ 102(e) Date: Mar. 16, 1993

[87] PCT Pub. No.: WO92/05352

PCT Pub. Date: Apr. 2, 1992

[30] Foreign Application Priority Data

Sep. 18, 1990 [EP] European Pat. Off. ..... 90117957.2

[51] Int. Cl.[5] ..... F02D 41/10

[52] U.S. Cl. ..... 123/492; 123/493

[58] Field of Search ..... 123/492, 493

[56] References Cited

U.S. PATENT DOCUMENTS 4,010,717 3/1977 Taplin ..... 123/492

4,924,835 5/1990 Denz ..... 123/478

FOREIGN PATENT DOCUMENTS 2163241 7/1973 France .

8802811 4/1988 PCT Int'l Appl. .

1449491 9/1976 United Kingdom .

*Primary Examiner*—Andrew M. Dolinar

*Attorney, Agent, or Firm*—Hill, Steadman & Simpson

[57] ABSTRACT

To determine a correction quantity (KM) of fuel injected in dynamic transition operation, the filter constants (A, B, C) of a filter characteristic are chosen as a function of operating parameters of the internal combustion engine.

5 Claims, 1 Drawing Sheet

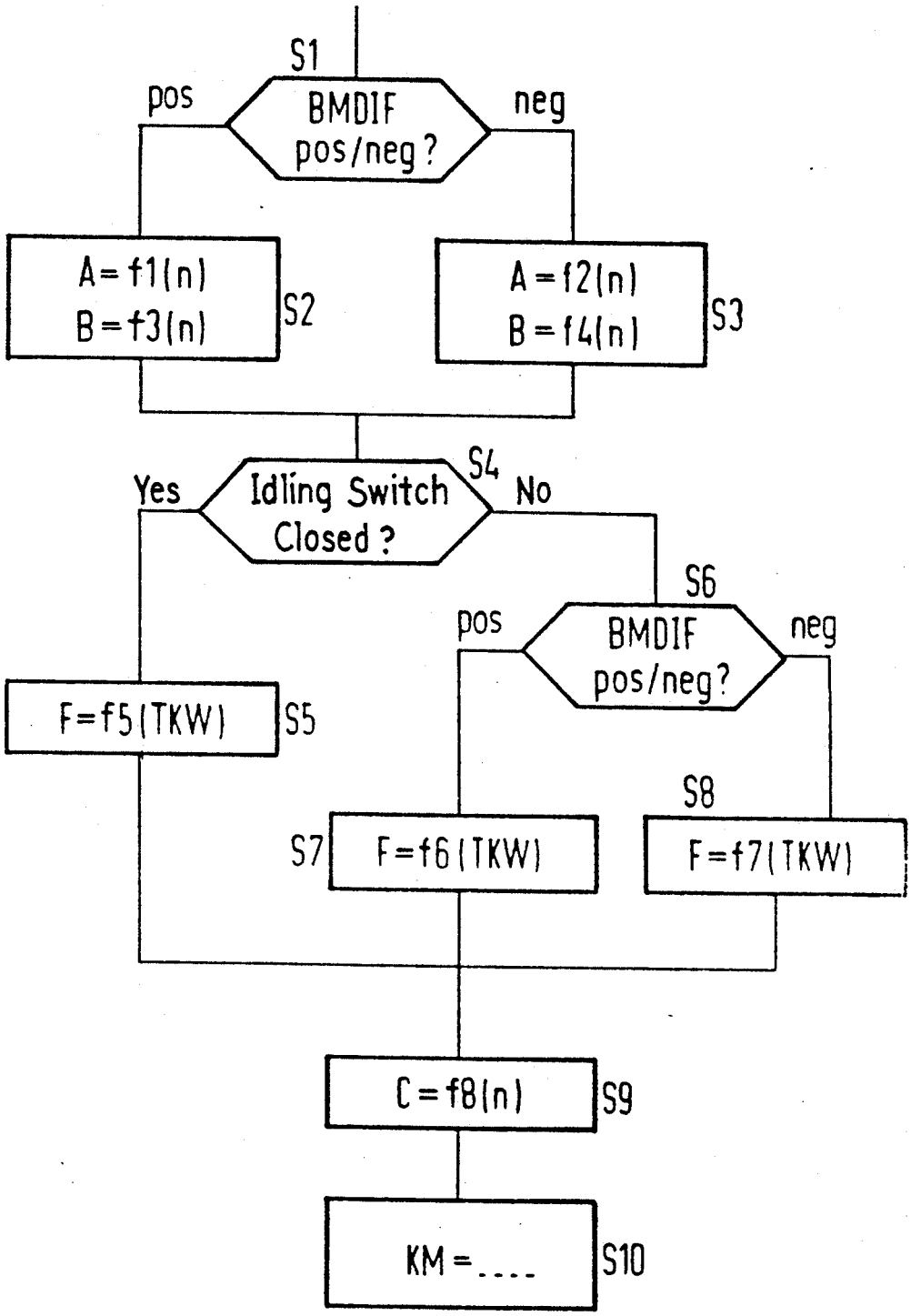
S1
BMDIF pos/neg ?
pos
neg
A=f1(n)
B=f3(n)
S2
A=f2(n)
B=f4(n)
S3
Idling Switch Closed ?
S4
Yes
No
S6
BMDIF pos/neg?
pos
neg
F=f5(TKW)
S5
S7
F=f6(TKW)
S8
F=f7(TKW)
C=f8(n)
S9
KM=....
S10

METHOD FOR DETERMINING THE QUANTITY OF FUEL INJECTED

BACKGROUND OF THE INVENTION

The invention relates to a method for determining the quantity of fuel injected for an internal combustion engine in dynamic transition operation.

In dynamic transition operation, such as, for example, acceleration or overrunning, a basic quantity of fuel to be injected must be increased or reduced in relation to the conditions in the steady-state operating condition. For this purpose, a correction quantity of fuel injected is used, this being determined by first of all determining a base quantity from the load and speed. This base quantity is in each case differentiated in order thereby to evaluate the degree to which the operating condition has changed. Finally, filtering is also carried out, in order to simulate the filling of the suction pipe, the build up and decay of the wall film and to compensate disturbing influences. The differentiated base quantity is here subjected as a filter input variable to a filter characteristic which contains various filter constants. These filter constants are determined experimentally and are constant.

In road tests, it has been ascertained that correction quantities of fuel injected determined in this way are in some cases too small or too large by a multiple of their order of magnitude. Moreover, they are strongly dependent on the operating point and the method is only designed for a warm engine.

FR-A-21 63 241 discloses an electrically controlled fuel injection device for internal combustion engines, in which pulsations of the air quantity signal are smoothed out with the aid of a filter.

PCT reference WO-A-88 02 811 (corresponding to U.S. Pat. No. 4,924,835) discloses the filtering of the output signals obtained from various operating parameters; likewise in order to smooth out pulsations. The filtering inevitably results in a delay in the event of a change in the signal. In order to match the said signals to the particular situation, the filter characteristic is in both cases made dependent on parameter changes. No alteration is made to the magnitude of the signal.

SUMMARY OF THE INVENTION

The object of the invention consists in specifying a method of the type stated at the outset which always supplies correction quantities of fuel injected which are as accurate as possible.

According to the present invention the object is achieved by a method for determining the quantity of injected fuel for an internal combustion engine during dynamic transition operation, in which a correction quantity of injected fuel is determined and the normal basic quantity of injected fuel is increased or decreased by this amount. The correction quantity of injected fuel is obtained from a base quantity determined from load and speed by a procedure. In the procedure the base quantity is differentiated and subjected to filtering in accordance with a filter characteristic with at least one filter constant, wherein the filter constant is dependent on operating parameters of the internal combustion engine.

The following are advantageous developments of the present invention. In one embodiment the filter constant is chosen differently depending on whether the differentiated base quantity, that is the filter input signal, is positive or negative. In each case the filter constant is dependent on the speed. In another embodiment the filter constant is multiplied by a correction factor which is chosen differently depending on whether the differentiated base quantity is positive or negative. In each case the filter constant is dependent on the cooling water temperature. The correction factor is furthermore chosen differently depending on whether or not the engine is idling.

The invention is based on the realization that it is the use of fixed filter constants which cause the inaccuracies in the determination of the correction quantity of fuel injected. Sufficient accuracy is, on the other hand, achieved if use is made of variable filter constants which are dependent on operating parameters of the internal combustion engine. The dependence on the operating point is thereby compensated and sufficient accuracy can be achieved even when the engine is cold.

Suitable operating parameters for this purpose are, for example, the speed, the change in the movement of the throttle valve, the cooling water temperature and a signal which indicates that the engine is idling etc.

BRIEF DESCRIPTION OF THE DRAWING

The features of the present invention which are believed to be novel, are set forth with particularity in the appended claims. The invention, together with further objects and advantages, may best be understood by reference to the following description taken in conjunction with the accompanying drawing, and in which:

The single FIG. is a flow diagram that shows how the filter constants A, B and C of a filter characteristic are altered as a function of operating parameters.

DESCRIPTION OF THE PREFERRED EMBODIMENT

The method is employed in a customary fuel injection system. The normal basic quantity GM of fuel injected is here determined from a set of characteristics as a function of load and speed n of the internal combustion engine. For this purpose, the signal of an air mass meter, a vacuum sensor in the intake pipe or a throttle valve opening sensor is, for example, used for determining the load.

A correction quantity KM of fuel injected is here calculated continuously at the same time but this only comes into action in dynamic transition operation. The starting point is a base quantity BM, which is either the same as the basic quantity GM of fuel injected already determined or is taken from a second set of characteristics plotted against load and speed n. This base quantity BM is differentiated, with the result that a value other than zero only occurs in dynamic transition operation—that is to say in the case of changes in the operating condition. This differentiated base quantity BMDIF is then filtered using a filter characteristic. The filter characteristic has the general form $$KM(m)=[A*BMDIF(m)-B*BMDIF(m-1)]F+C*KM(m-1)$$

where

BMDIF is the differentiated base quantity,

A, B, C are filter constants,

F is a factor, m is a running variable and

KM is the correction quantity of fuel injected resulting from the filtering.

In step S1 of the flow diagram in the figure, the program enquires whether the differentiated base quantity BMDIF is positive or negative. This is an indication of whether the vehicle is in acceleration or deceleration mode.

In the case of acceleration, BMDIF is positive and step S2 follows, in which the filter constants A and B are determined. The filter constants A and B are each stored in the form of a one-dimensional set of characteristics as a function of the speed n. If, on the other hand, the vehicle is decelerating, the answer in step S1 was negative and step S3 follows, the constants A and B being assigned in accordance with f2 (n) and f4 (n).

The functional relationships f1 to f4 (n) stored in the sets of characteristics are determined by road tests or on the engine test bed.

In step S4, the program enquires whether an idling switch is closed, i.e. whether the throttle valve is closed or not. If the engine is idling, then in step S5 the factor F is determined in accordance with the function f5 as a function of the cooling water temperature TKW. If, on the other hand, the engine is not idling, then in step S6 the program enquires again whether the differentiated base quantity BMDIF is positive or negative. Depending on the result, either step S7 or step S8 follows, the factor F being fixed in accordance with the function f6 or f7. Functions f5 to f7 as a function of the cooling water temperature TKW are likewise determined by road tests or on the engine test bed.

Finally, the filter constant C is determined in step S9 from function f8 as a function of the speed.

Filter constants A, B and C and factor F have now been fixed as a function of operating parameters. In step S10, the correction quantity KM of fuel injected can then be determined from equation 1 mentioned at the outset. This correction quantity KM of fuel injected can have a positive or negative sign and is added or subtracted from the basic quantity GM of fuel injected accordingly.

The invention is not limited to the particular details of the method depicted and other modifications and applications are contemplated. Certain other changes may be made in the above described method without departing from the true spirit and scope of the invention herein involved. It is intended, therefore, that the subject matter in the above depiction shall be interpreted as illustrative and not in a limiting sense.

What is claimed is:

1. A method for determining a quantity of fuel injected for an internal combustion engine during dynamic transition operation, comprising the steps of:

providing a base quantity of injected fuel as a function of load and speed of the internal combustion engine;

differentiating the base quantity;

filtering the differentiated base quantity using a filter characteristic having at least one filter constant to provide a correction quantity of injected fuel, the at least one filter constant being a function of at least one operating parameter of the internal combustion engine; and changing a normal basic quantity of injected fuel by the amount of the correction quantity of injected fuel during the dynamic transition operation.

2. The method as claimed in claim 1, wherein the filter constant is chosen differently depending on whether the differentiated base quantity as a filter input signal is positive in a first case or negative in a second case and wherein in each of the first and second cases the filter constant is dependent on the speed.

3. The method as claimed in claim 1, wherein the filter constant is multiplied by a correction factor which is chosen differently depending on whether the differentiated base quantity as a filter input signal is positive in a first case or negative in a second case and wherein in each of the first and second cases the filter constant is dependent on the cooling water temperature.

4. The method as claimed in claim 3, wherein the correction factor is furthermore chosen differently depending on whether or not the engine is idling.

5. The method as claimed in claim 1, wherein if the correction quantity has a positive sign, the correction quantity is added to the normal basic quantity, and wherein, if the correction quantity has a negative sign, the correction quantity is subtracted from the normal basic quantity.

* * * * *